United States Patent [19]

Cycowicz et al.

[11] 4,077,663

[45] Mar. 7, 1978

[54] RECLINER LOUNGERS

[75] Inventors: Izchak Cycowicz, Brooklyn, N.Y.; Robert Joseph Caldwell, Bayonne, N.J.; Ming-Shean Ueng, New York, N.Y.

[73] Assignee: Mohasco Corporation, Amsterdam, N.Y.

[21] Appl. No.: 683,480

[22] Filed: May 5, 1976

[51] Int. Cl.[2] ..... A47C 1/02

[52] U.S. Cl. ..... 297/83; 248/430; 297/322

[58] Field of Search ..... 297/68, 83–88, 297/316–318, 322, 329, 342; 312/335, 338–344; 248/429, 430; 308/3.8

[56] References Cited

U.S. PATENT DOCUMENTS

| | | | |
|---|---|---|---|
| 2,418,244 | 4/1947 | Baird | 308/3.8 X |
| 2,898,159 | 8/1959 | Arnit | 308/3.8 |
| 2,985,491 | 5/1961 | Hayes | 308/3.8 |
| 3,550,952 | 12/1970 | Ferguson | 297/85 |
| 3,701,577 | 10/1972 | Fischer | 312/339 |
| 3,758,151 | 9/1973 | Ré | 297/83 |
| 3,858,932 | 1/1975 | Crum et al. | 297/83 X |
| 3,871,705 | 3/1975 | Harrison | 297/61 |
| 3,880,462 | 4/1975 | Mednick | 297/84 |
| 3,958,827 | 5/1976 | Ré | 297/85 X |

FOREIGN PATENT DOCUMENTS

| | | | |
|---|---|---|---|
| 233,760 | 5/1964 | Austria | 312/339 |
| 73,143 | 9/1960 | France | 312/341 |

*Primary Examiner*—Roy D. Frazier
*Assistant Examiner*—William E. Lyddane
*Attorney, Agent, or Firm*—J. B. Felshin

[57] ABSTRACT

This chair comprises a chair body having arm rests and being fixed to tracks mounted for longitudinal movement on stationary tracks supported on a floor. Seat links, a leg rest and linkage mechanism connecting said seat links and leg rest to the body and to each other, permit the seat links, and leg rest to be moved from upright position to T.V. position, and then to fully reclined position, and back to T.V. position and upright position. Links are pivoted, connecting the stationary tracks and the movable tracks with said linkage mechanism, to move the body and its movable tracks, longitudinally forwardly relative to the stationary tracks as the seat links, backrest and leg rest move from upright to T.V. position, and to then move the body and its movable track, further forwardly longitudinally relative to the stationary track, as the seat links, backrest and leg rest move from T.V. position to fully reclined position.

20 Claims, 16 Drawing Figures

RECLINER LOUNGERS

This invention relates to a chair in which the body and arm rests move away from a wall near which the chair stands, as the chair moves from upright position to a position in which the backrest of the chair and seat incline, so that the backrest does not contact the wall.

One object of this invention is to provide a highly improved chair of the character described comprising stationary tracks supported on a floor and a body with arm rests fixed to movable tracks mounted on the stationary tracks for longitudinal movement thereon.

Another object of this invention is to provide a chair of the character described in which the path of the forwardly moving chair is controlled by a movable track which is rigidly fastened to the armrest of the body of the chair and rolls on a front wheel, the axle of which is mounted on a stationary track resting on the floor, said movable track carrying a wheel on an axle located at the rear of the movable track and rolling on the stationary track, said tracks having means acting to prevent the wheels from sliding laterally off the tracks, thus minimizing lateral play of the chair relative to the fixed tracks and maintaining straight line movement of the movable track.

Yet another object of this invention is to provide a chair of the character described in which the tracks have means near the wheels to restric vertical movement of the movable tracks relative to the stationary tracks, thus minimizing rocking movement of the chair relative to the stationary tracks.

A further object of this invention is to provide a chair of the character decribed having adjustable cantilevered front feet on the stationary tracks to assure forward stability when the chair is in forward fully reclined position regardless of weight distribution due to styling.

A still further object of this invention is to provide a chair of the character described in which the points of contact of the wheels with the tracks is well above the floor to ensure that thick shag carpets are not gripped by the wheels when the chair is moved to various positions of the occupant support means.

Still a further object of this invention is to provide a chair of the character described in which as the wheels move closer together they remain close to the center of gravity of the occupant's mass.

A still further object of this invention is to provide a chair of the character described in which the controlling links which move the movable track, are inside the hardware for projecting the legrest, thus enabling use of stabilizing crossrails and in which the operating linkage to move the arm rests relative to the fixed tracks is connected to portions of the legrest projecting mechanism accessible from the inside of the chair between the mechanism at opposite sides of the chair.

Another objct of this invention is to provide a chair of the character described, in which a seat link is moved rearward and at same time its front end is tilted upwardly when moving from upright to T.V. position and in which a legrest bellcrank has an upwardly extending arm pivoted to the seat link near the front end of the seat link, and a forwardly extending arm pivoted at its forward end to the legrest projecting linkage, in which a drive bell crank has an arm pivoted at one end to the front end of the arm rest, and another arm connected by a secondary drive link to the front end of the stationary track, and the drive bell crank is pivoted mediately the ends thereof, to a primary drive link pivoted to said upwardly extending arm of the legrest bell crank, the arrangement being such that as the seat link is pushed back and tilts on going from upright to T.V. position, the primary drive link is pulled upwardly and rearwardly causing the drive bell crank to pivot about its pivotal connection to the arm rest, thereby causing the arm rest to move forwardly relative to the stationary track and to lower the pivotal connection of the drive bell crank to the secondary drive link, and to cause the arm rest to move further forwardly relative to the stationary track, upon moving the seat link from T.V. position to fully reclined position, thereby still further lowering the pivotal connection of the drive bell crank to the secondary drive link, until the fully reclined position is reached, in which position a fixed stop contacts the secondary drive link.

Still another object of this invention is to provide a durable chair of the character described which shall be relatively inexpensive to manufacture, easy to manipulate and comfortable in use.

Other objects of this invention will in part be obvious and in part hereinafter pointed out.

The invention accordingly consists in the features of construction, combinations of elements, and arrangement of parts which will be exemplified in the construction hereinafter described and of which the scope of invention will be indicated in the following claims.

IN THE DRAWINGS

Figures 1, 4:
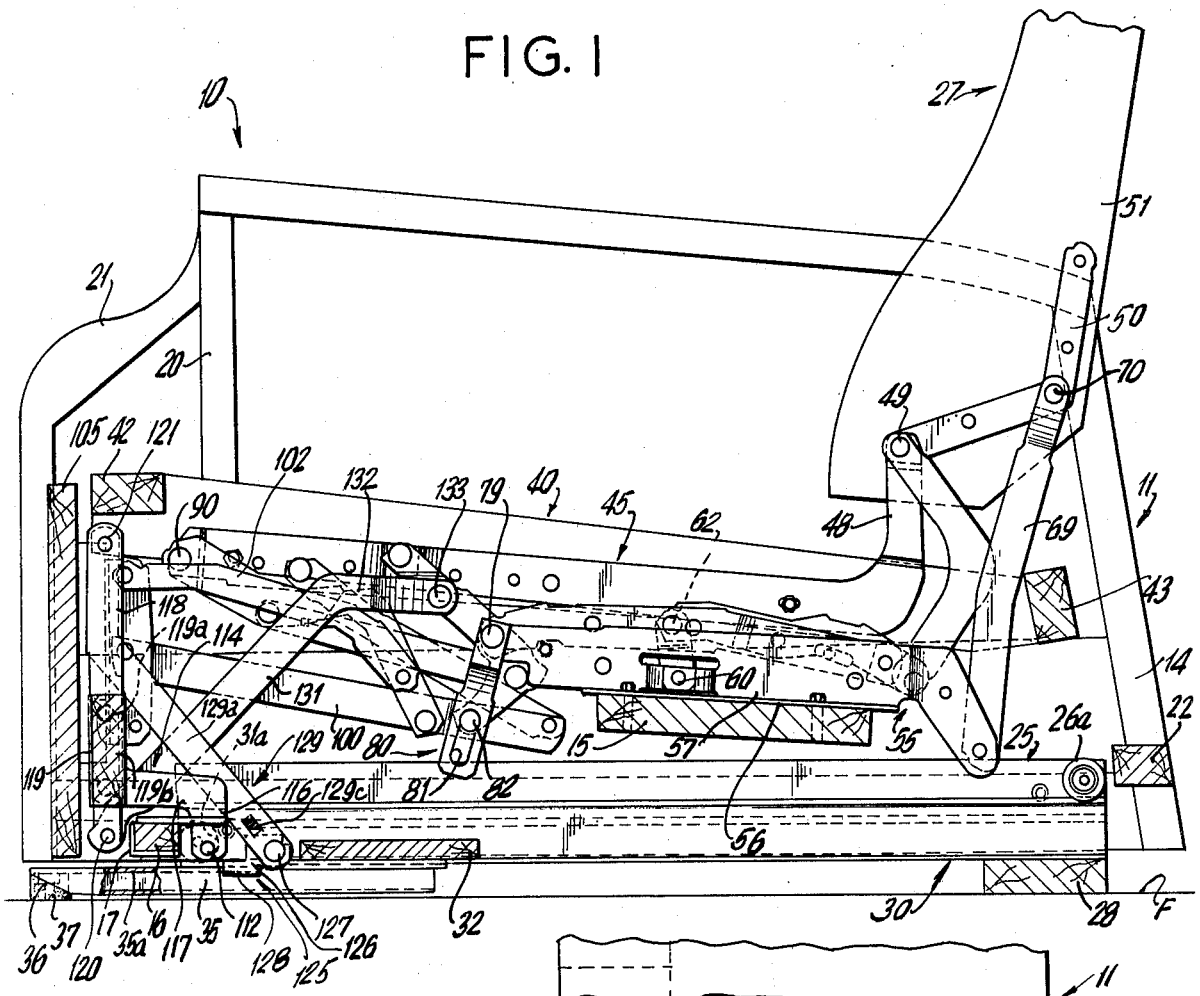
FIG. 1 is a side view of a chair embodying the invention, looking from the inside of the chair toward the right side of the chair, and showing the chair in an upright position.
FIG. 4 is a partial rear vertical view of the lower right end of the chair.

Referring now in detail to the drawing, 10 designates a chair embodying the invention, and here shown in the form of a lounger. The chair 10 comprises a chair body or frame 11 having left and right similar, symmetrical arm rests 12, (only the right arm rest is shown). Arm rest 12 comprises a vertical inner, wall **12*a*, and bottom filler or former 12*b* connected by a front wall 13 and a rear wall 14. The inner walls 12*a* are interconnected by a cross rail 15. The frame or body also comprises a front cross rail 16 which may be sheathed in a sheet metal angle shaped partial cover 17** covering the front and bottom surfaces of said cross-rail.

Arm rests 11 also include arm member 19, vertical members 20 and top front, inclined members 21 in the well known manner. A rear cross-rail 22 reinforces the rear ends of the arm rests.

Fixed to the inner side of the arm rests are horizontal movable tracks 25. The track 25 on the right side of the chair only is shown in FIG. 4. Said movable track 25 has an upwardly projecting, horizontally extending vertical flange **25*a* lying against the inner side of inner arm rest wall 12*a* and is fixed thereto by any suitable fasteners, not shown. Extending inwardly from the lower end of flange 25*a* is a horizontal web 25*b* provided at its inner end with a short downwardly extending flange 25*c* (see FIG. 4). Web 25*b* is formed with an upwardly extending boss 25***d* for the purpose hereinafter appearing. A pair of plastic bumper buttons 25*e* are fixed to flange 25*a* and have heads 25*f* projecting inwardly of said flange.

Fixed to the rear end of flange 25*a* is in axle 26 on which is rotatably mounted a nlyon or other low frictional wheel 26*a* on ball bearings and projecting down to a level above web 25*b* and inwardly somewhat beyond flange 25*c*, for the purpose hereinafter appearing.

The chair 10 can be located near a vertical wall (not shown) of the room in which the chair is placed. The chair, as will be explained hereinafter, has a reclining backrest 27, which in the upright position of the chair, may be located close to the wall (not shown).

Resting on the floor F, near the vertical wall (not shown), is a cross board or support 28. Resting on and fixed to the cross board 28 are a pair of parallel horizontal stationary tracks 30. Only the right track 30 will be described and shown, as said tracks are similar, and symmetrically disposed one to the other. The stationary track 30 on the right side of the chair is shown in cross-section in FIG. 4 of the drawing. Said track 30 comprises a horizontal flange 30*a* the rear end of which lies on the cross board 28. Extending up from the outer end of flange 30*a* is a vertical web 30*b* disposed parallel to and spaced inwardly of flange 25*c* of the movable track. Extending outwardly from the upper end of web 30*b* is a horizontal web 30*c* on which the wheel 26*a* rolls. Wheel 26*a* contacts web 30*c* at the bottom of the wheel. Extending up from the outer end of web 30*c* is a short vertical flange 30*d* disposed between the wheel 26*a* and the head 25*f* of plastic button 25*e*. Projecting down from web 30*c* is a boss 30*e* placed close to the wheel 31*a* and projecting up from web 25*b* is a boss 25*d* near wheel 26*a*. Mounted on web 30*b*, just below web 30*c* are plastic bumper buttons 30*f*, having head 30*g* in opposed relation to web 25*c* of track 25. Mounted on the web 30*b*, adjacent the front end of track 30 is an axle 31 carrying a wheel 31*a* which contacts the underside of web 25*b* and lies between flange 25*c* and the arm rest 11. The flanges 30*a* on both sides of the chair are interconnected in a suitable manner by a cross rail 32 overlapping said flanges.

Hollow, tubular cantilevered feet 35 are fixed to the undersides of the flanges 30*a* of stationary tracks 30 and project forwardly thereof in alignment therewith. The front ends of said feet 35 are cut away at a downwardly and rearwardly inclined slant, at their front ends as shown at 36 and buttons 37 are fixed to the undersides of the top wall 35*a* at the front ends of said feet to contact the floor F to keep the undersides of said feet 35 somewhat above the floor level. The cantilever feet may be made of wood if desired.

The stationary tracks are thus supported at their rear ends by board 28 and at their front ends by buttons 37.

The chair 10 comprises a seat frame 40 comprising parallel side walls 41 interconnected at their front ends by a cross wall 42 and at their rear ends by a cross wall 43.

Figure 3:
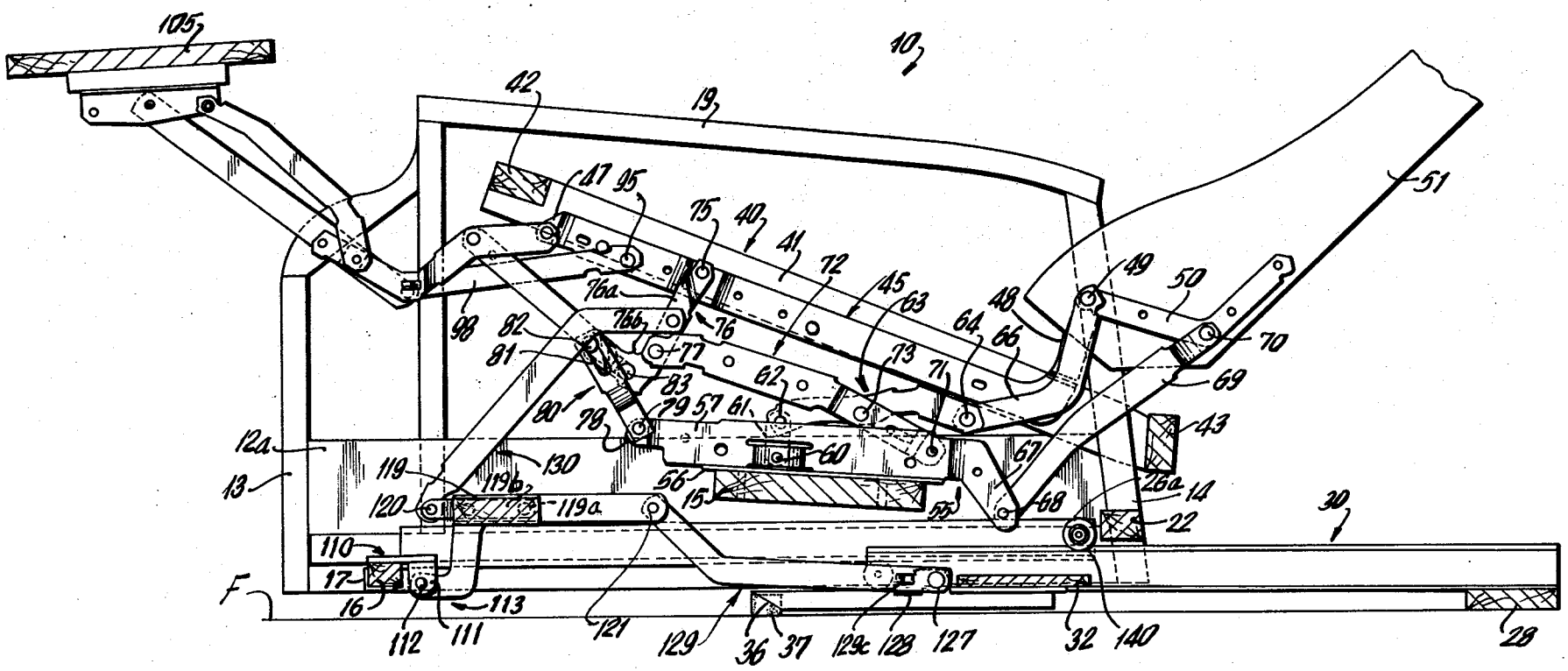
FIG. 3 is a view similar to FIG. 2 but showing the chair in fully reclined position.
Figure 5:
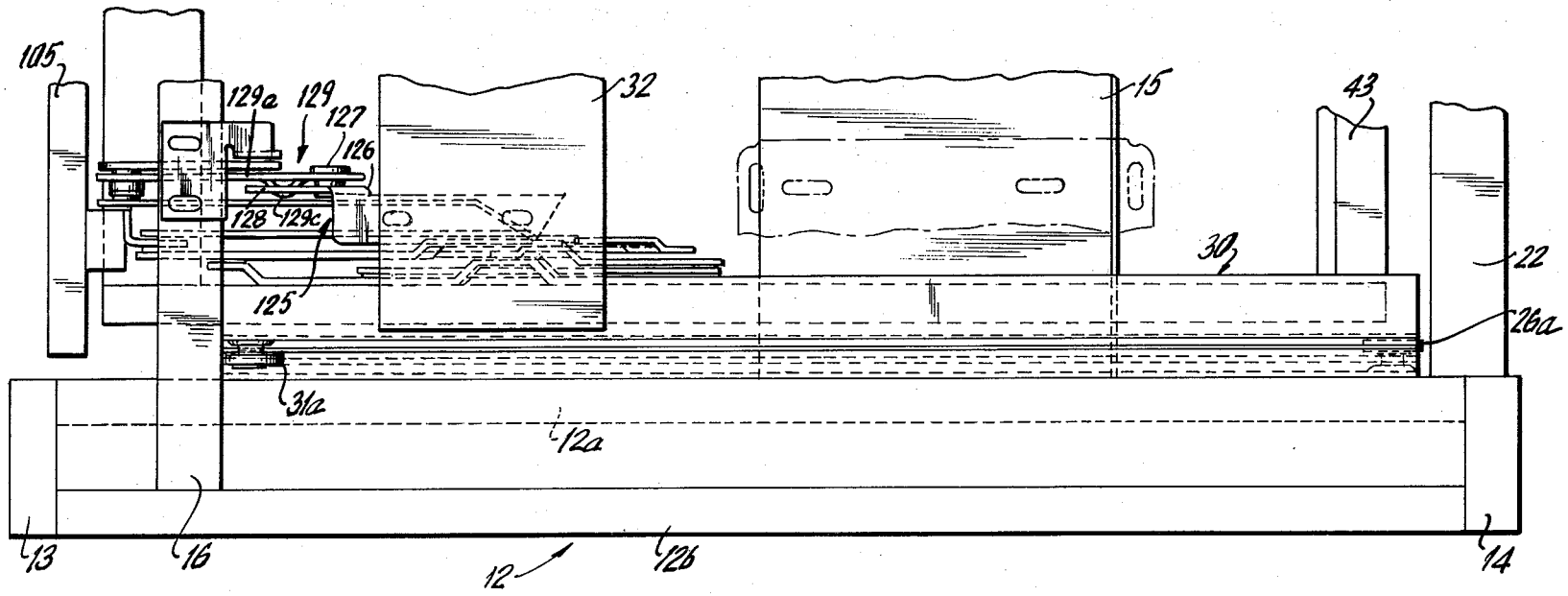
FIG. 5 is a partial bottom view of the right side of the chair.

Fixed to the inner sides of walls 41 are seat links 45. Only the seat link and its controlling means on the right side of the chair will be described because only the right side is shown and at any rate both sides are similar and symmetrically disposed. Seat link 45 has longitudinal portion 46 having a front end 47. Extending from the rear of portion 46 is an upwardly curved arm 48. Pivoted to the upper end of arm 48 as at rivet 49, is a back rest mounting plate 50 fixed to side walls 51 of the back rest 27. Arms 48 are located forwardly of the rear rail 43 as shown in FIG. 3.

Fixed to the top of cross rail 15 at both sides of the chair are mounting plates 55. Only the plate 55 on the right side of the chair will be described. Mounting plate 55 comprises a bottom flange 56 from which a vertical flange 57 extends upwardly in a vertical plane. Pivoted to the mounting plate as at 60 is a short link 61. Pivoted to link 61 as at 62, is a link 63 which extends rearwardly. Pivoted to the rear end of link 63, as at 64, is a link 66. The upper end of link 66 is pivoted to the upper end of arm 48 as by pivot 49.

At the rear end of flange 57 is a downwardly and rearwardly inclined arm 67. Pivoted to the lower end of arm 67, as at 68, is a link 69 which is pivoted to mounting plate 50, as at 70.

Pivoted to the flange 57 at 71 near the rear end of said flange, is one end of a link 72 which crosses link 63 and is interpivoted thereto as at 73.

Pivoted to the seat link 45 as at 75 is a bellcrank 76. Bellcrank 76 has an upwardly extending arm 76*a*, the upper end of which carries the pivot 75. Extending forwardly from said arm 76*a* is an arm 76*b*. The front end of link 72 is pivoted to arm 76*a*, as at 77, above the junction of arms 76*a* and 76*b*.

Pivoted to an ear 78 of flange 57 as at 79 is a lock arm 80 formed with a slot 81. On arm 76*b* of bellcrank 76 is a pin 82 slidable in slot 81. At the junction of arms 76*a*, 76*b* of bellcrank 76 is a pivot pin 83. Pivoted to a pivot pin 90 on ear 47 of the seat link 45, is a link 91. A link 92 is pivoted, at one end, as at 93, to an intermediate portion of link 91. At its other end, link 92 is pivoted to the pivot pin 83 at the junction of arms 76*a*, 76*b* of bellcrank 76. Pivoted to the seat link 45 as at 95, between the pivots 90 and 75, is a link 98. Pivoted to the front end of link 98, as at 99, is one end of a link 100. The front end of link 91 is pivoted, as at 101, to an intermediate portion of link 100. A link 102 is pivoted to link 91 as at 103 near pivot 101. Links 100, 102 are pivoted as at 100*a*, 102*a*, respectively to a leg rest bracket 104 supporting a leg rest frame 105. The linkage mechanism begining with link 61 and ending with the leg rest bracket 104 is closed to structure described and shown in U.S. Pat. No. 3,550,952, with small modifications, and operates similarly thereto.

In the upright position of the chair 10, as illustrated in FIG. 1 of the drawing, the legrest is vertical. The lock member projects down from pivot 79 and pin 82 is at the upper end of the slot 81.

Figure 2:
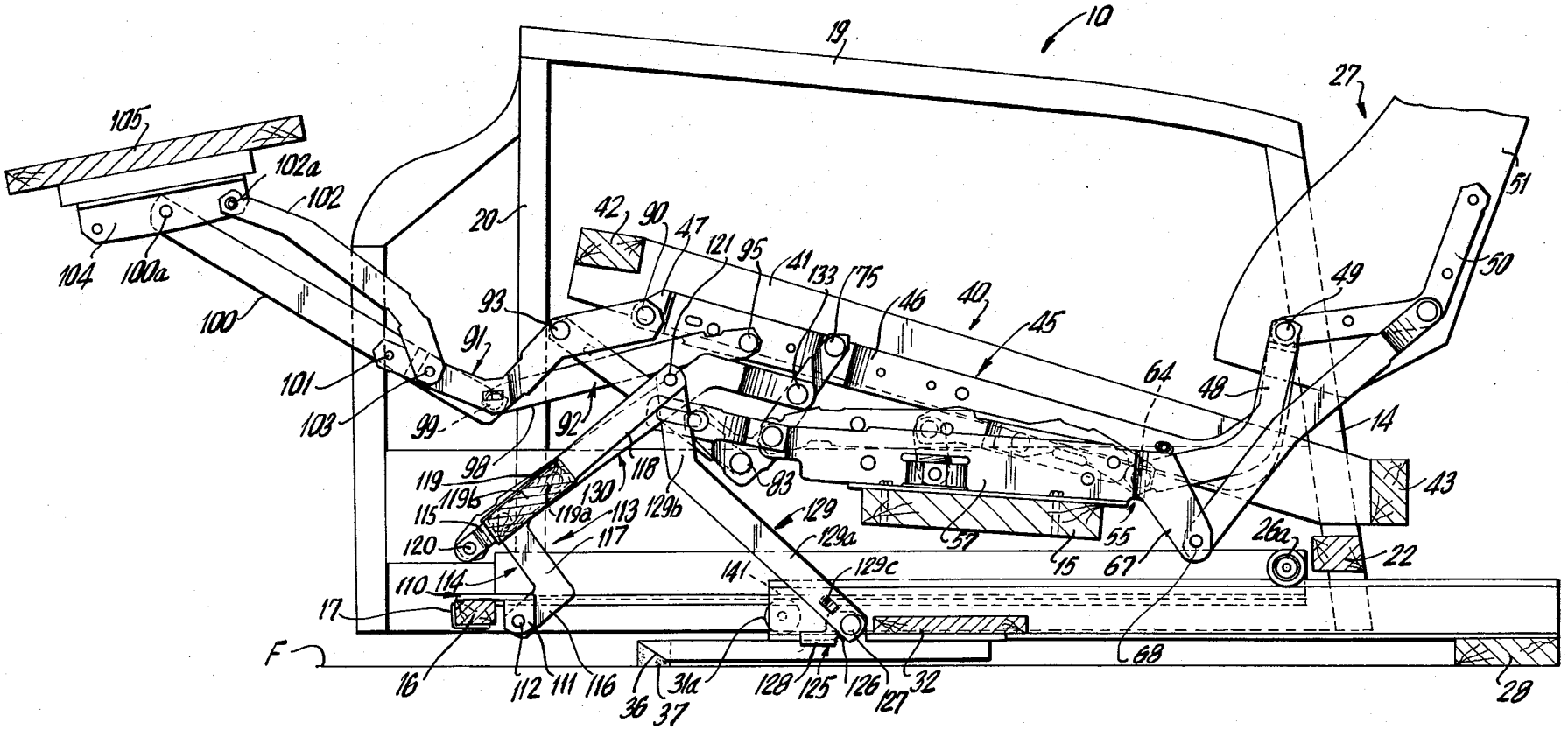
FIG. 2 is a view similar to FIG. 1 but showing the chair in T.V. inclined position.

To go to T.V. inclined position, the occupant holds the arm rests and pushes back on the seat and backrest, causing the seat to tilt up to the position of FIG. 2. This action causes bellcrank 76 to swing in a clockwise direction, looking at FIGS. 1 and 2, to project the legrest. During this motion link 72 cannot swing up because pin 82 on said bell crank 76 cannot move up, being at the upper end of slot 81. However lock 80 swings in a clockwise direction to its FIG. 2 position. When the T.V. FIG. 2 position is reached, further pressure will allow link 72 to swing up in a clockwise direction about pivot 71 and allow the seat to move from T.V. position to fully reclined position.

Means is provided to cause the body of the chair and the track 25, to move together longitudinally forwardly relative to the stationary track 30, when going from upright to T.V. position and then to move said body and movable track further together forwardly, relative to the stationary track, when going from T.V. position to fully reclined position.

To this end there is fixed to the upperside of front cross brace 16, a movable pivot plate or bracket 110 having a downwardly projecting apertured ear 111. Pivot to ear 111 as on pivot pin 112 is a base drive bellcrank 113. Said bellcrank 113 comprises two parts attached together. One part is part 114 and the other part is part 115 attached fixedly thereto. Part 114 is Z-shaped and comprises an arm 116 projecting vertically downwardly in the upright position of the chair as shown in FIG. 1. The lower end of arm 116 is pivoted to the pivot 112. Extending forwardly from the upper end of arm 116 is an intermediate horizontal portion 117 (in the FIG. 1 position). Extending vertically upwardly from the forward end of portion 117 is an arm 118. Part 115 may be a straight bar the lower end of which projects below portion 117 and carries a pivot pin 120 for the purpose hereinafter explained. A bracket 119 overlies arm 118 and is riveted thereto and to part 115 by rivets 119*a*. In the upright position of the chair shown in FIG. 1, arm 118 is in vertical position and its upper end is disposed just forwardly of pivot 90 at the front end of the seat link 45. At the upper end of said arm 118 is a pivot pin 121.

Attached to the underside of base front cross rail 32 is a stationary pivot plate 125 provided at its forward end with an upwardly extending ear 126 carrying a pivot pin 127 and having a forwardly extending finger 128. Pivoted to said pin 127 is a base secondary drive link 129. Said drive link 129 is formed with a pushed out projection 129*c*. Extending vertically upwardly from the upper end of inclined arm 129*a* is an arm 129*b*, the upper end of which is pivoted to the upper end of arm 118 by said pivot pin 121. As shown in FIG. 1, arm 129*b* coincides with arm 118 in the FIG. 1 position of the chair. Pivoted to said pivot pin 120 is a base primary drive link 130. Link 130 comprises a portion 131 inclined upwardly and rearwardly in the upright position of the chair as shown in FIG. 1. Extending rearwardly from the upper end of portion 131, in said FIG. 1 position, is a portion 132 pivoted as at 133 to arm 76*a* of bellcrank 76 at a point between pivot 75 and pivot 77. Arm 129*a* is formed with a push out projection 129*c* adapted to contact finger 128 as the chair reaches fully reclined position.

As the chair is moved from the upright position of FIG. 1 to the T.V. position of FIG. 2, the top portion 76*a* of bellcrank 76 rotates rearwardly (clockwise in the drawing) driving base primary drive link 130 rearwardly relative to the body 11 of the chair.

Base primary drive link 130 drives the portion 117 of part 114 upwardly and rearwardly relative to the body 11, causing bellcrank 113 to rotate clockwise of the drawing. Arm 118 of bellcrank 113 rotates rearwardly and downwardly relative to the body 11, and drives base drive bellcrank 129 rearwardly relative to the body 11. Base secondary drive link 129, in turn, drives stationary pivot plate 125 rearwardly of the body 11 thus driving stationary track 30 rearwardly relative to the body 11 or conversely the chair body is moved forwardly relative to the stationary track because base drive bellcrank 113 is pivoted at 112 to the front end of the movable track 25.

When the movable track reaches the T.V. position, the front wheel 26*a* on one side of the chair could drop into a small recess in web 30*c* of the fixed track 30 and wheel 31*a* on the fixed track can enter a small recess 141 at the underside of web 25*b* of track 25, to releasably hold the chair in T.V. position.

The plastic buttons on opposite sides of the chair prevent the wheels from laterally sliding off the tracks or from striking the flanges 30*d* and 25*c*, thus minimizing lateral play of the chair relative to the track base.

The shallow bosses 30*e*, 25*d* near the wheels restrict vertical movement of the movable track relative to the stationary track thus minimizing rocking movement of the chair body relative to the stationary track. The plastic buttons 25*f*, 30*g* furthermore maintain straight line movement of the movable track, front to rear and vice-versa while preventing any metal to metal contact and noise.

As the chair is moved fromT.V. position to recline position, bellcrank 76 moves upward to pull the rear end of base primary drive link 130 upward and the front end of the base primary drive link upward and rearward, thus further rotating base drive bellcrank 113 clockwise on the drawing. This action continues to drive the body of the chair and the movable track 25 further forward until, at the fully reclined position, the pivot pin 121 joining the base drive bellcrank 113 with the base secondary drive link 129 approaches the common center line of the pivot rivet 112 connecting the base drive bellcrank 113 and movable plate 110 and the pivot rivet 127 connecting the base secondary drive link 129 and stationary pivot plate 125. The arm 116 of the base drive bellcrank 113 and the arm 129*a* of secondary drive link 129 approach a straight line in their fully extended position as shown in FIG. 3. Lug or finger 128 on stationary pivot plate 125 stops secondary drive link 129 by engaging push out projection 129*c* and preventing link 129 from traveling overcenter and striking the floor.

The "Half-Track" construction disclosed herein provides more freedom of movement to the wheels, since it contacts the wheel only at the point of vertical support. Yet its unique retainer system provides more rigidity to the chair throughout its cycle. Pivoting the rear wheel on the movable track, and the front wheel on the stationary track, the distance between the wheels in the upright (closed) position is close to the depth of the armrest frame, greater than the corresponding distance on previous chairs. This gives the chair greater stability and more adequately supports the front of the chair as the occupant gets in and out of the chair. As the chair approaches recline position, the wheels move closer together, but remain near the center of gravity of the chair and occupant mass. This is sufficient since, in this position the occupant's mass is relatively immobile. A larger wheel can be used on the rear to carry the greater load in this area. This maximizes the life span of the rolling surface, and insures a smoother ride.

In prior art structures, the two wheels ride on top of a horizontal lower surface of a track. We moved the contact surfaces up $1\frac{1}{4}$ inches. The contact surface is at the top of the lower wheel at front end. At rear end it is still higher. Since the contact surfaces of the tracks are higher, there is less likelihood of gripping a thick shag carpet, which could stop the body of chair from moving.

The controlling 3 links herein are inside the hardware of the legrest. This enables putting in stabilizing cross-members 119*b* to connect brackets 119 on both sides of the chair. If the 3 links (control) were on the outside of legrest hardware, then you could not use the stabilizing cross rail 119*b*.

The operating device is connected to the bellcrank 76 which is accessible from the inside of the chair body between the opposite sides.

It will now be understood that path of the forwardly moving chair base is controlled by movable tracks resting on and traveling across front wheels, the axles of which are mounted on the stationary tracks, and by rear wheels, the axles of which are mounted on the movable tracks and roll along the stationary tracks. Means on the tracks is provided for preventing the wheels from sliding laterally off the tracks. Bumper buttons projecting from the tracks minimize lateral play of the chair body. Means is provided, on the tracks, near the wheels, to restrict vertical movement of the movable tracks relative to the stationary tracks thus minimizing rocking motion of the chair body. The plastic buttons on the tracks maintain straight line movement of the movable tracks front to rear and vice-versa while preventing metal to metal contact and consequent noise. An adjustable front foot assures forward stability when the chair is in the forward fully reclined position, regardless of weight distribution due to styling. The distance between the wheels reduces as the chair body moves forwardly, but remains substantially under or near the center of gravity of the occupant and chair body mass. The contact surfaces of the wheels is raised up above the floor to prevent gripping a thick shag carpet. The controlling links for moving the arm rest, are inside the legrest projecting hardware, enabling use of stabilizing cross-rails **119*b***. The controlling links are connected to parts of the mechanism, which are accessible from the inside of the chair between the arm rests.

It will thus be seen that there is provided an article in which the several objects of this invention are achieved, and which is well adapted to meet the conditions of practical use.

As possible embodiments might be made of the above invention, and as various changes might be made in the embodiments above set forth, it is to be understood that all matter herein set forth or shown in the accompanying drawings, is to be interpreted as illustrative only.

What is claimed is:

1. A chair comprising a chair body, a horizontal stationary track adapted to be supported on a floor, means for mounting said chair body on said stationary track for horizontal longitudinal sliding movement of said body relative to said stationary track, a seat link, linkage mechanism connecting said seat link with said body to permit movement of the seat link from upright chair position to inclined position and back from inclined position to upright position, and linkage connecting said stationary track with said linkage mechanism, to cause said body to move longitudinally forwardly relative to said stationary track while being slidably supported on said stationary track, as said seat link moves from upright chair position to inclined chair position, and to move said body rearwardly relatively to said stationary track as said seat link moves back from inclined position to upright position, said linkage comprising a first link pivoted to said body, a second link pivoted to said stationary track and to said first link, a third link pivoted to said linkage mechanism, and means to movably interconnect said third link to one of said first and second links.

2. The combination of claim 1, a legrest member, means for projecting and retracting said legrest member, means to connect said linkage mechanism to said legrest member projecting means, and said means to connect said linkage to said linkage mechanism, including means to actuate said legrest member projecting means for projecting said legrest member upon moving said seat link from upright position to inclined position, and for retracting said legrest member upon moving said seat link from inclined to upright position.

3. The combination of claim 1, said means for mounting said chair body on said stationary track comprising a horizontal movable track fixed to said body, a wheel rotatably mounted on the stationary track and having rolling contact with an undersurface of said movable track, and a wheel rotatably mounted on said movable track and having rolling contact with a top surface of said stationary track adjacent the upper end of said stationary track and being located above the first mentioned wheel.

4. The combination of claim 3, said wheel which is rotatably mounted on said movable track being located near the rear end of said movable track, said wheel which is rotatably mounted on said stationary track being located near the front end of said stationary track.

5. The combination of claim 4, said stationary track comprising a flange projecting up between the wheel on the movable track and a portion of the movable track on which the wheel on the movable track is mounted, the movable track having a downwardly extending flange extending between the wheel on the stationary track and a portion of the stationary track on which the wheel on the stationary track is mounted.

6. The combination of claim 5, and bumper buttons on said tracks to limit sidewise movement of said tracks toward each other.

7. The combination of claim 1, and a foot attached to the front end of the stationary track and projecting forwardly thereof.

8. The combination of claim 1, said means for mounting said chair body on said stationary track comprising a horizontal movable track fixed to said body, a wheel rotatably mounted on the stationary track and having rolling contact with an undersurface of said movable track, and a wheel rotatably mounted on said movable track and having rolling contact with a top surface of said stationary track, said body comprising side arms, said movable track being located at the outer side of the side arm to which it is attached, and a front cross rail interconnecting said side arms and disposed beneath said movable track.

9. The combination of claim 8, and metal sheathing on said front cross rail.

10. The combination of claim 1, said linkage being located on the side of said linkage mechanism toward the middle of the body of the chair.

11. The combination of claim 10, said means for mounting said chair body on said stationary track comprising a movable track fixed to said body, a wheel rotatably mounted on the stationary track and having rolling contact with an undersurface of said movable track, and a wheel rotatably mounted on said movable track and having rolling contact with a top surface of said stationary track, said body comprising side arms, said movable track being located at the outer side of the side arm to which it is attached, and a front cross rail interconnecting said side arms and disposed beneath said movable track.

12. A chair comprising a chair body, a horizontal stationary track adapted to be supported on a floor, means for mounting said chair body on said stationary track for horizontal longitudinal sliding movement of said body relative to said stationary track, a seat link, linkage mechanism connecting said seat link with said body to permit movement of the seat link from upright chair position to inclined position and back from inclined position to upright position, and linkage connecting said stationary track with said linkage mechanism, to cause said body to move longitudinally forwardly relative to said stationary track while being slidably supported on said stationary track, as said seat link moves from upright chair position to inclined chair position, and to move said body rearwardly relatively to said stationary track as said seat link moves back from inclined position to upright position, said linkage comprising a bellcrank pivoted to said body, a link pivoted to said stationary track, and to said bellcrank and link means pivotally connecting said bellcrank to said linkage mechanism, said link means being pivoted to said bellcrank between the pivotal points of said bellcrank to said body and to said linkage mechanism.

13. A chair comprising a chair body, a horizontal stationary track adapted to be supported on a floor, means for mounting said chair body on said stationary track for horizontal longitudinal sliding movement of said body relative to said stationary track, a seat link, linkage mechanism connecting said seat link with said body to permit movement of the seat link from upright chair position to inclined position and back from inclined position to upright position, and linkage connecting said stationary track with said linkage mechanism, to cause said body to move longitudinally forwardly relative to said stationary track while being slidably supported on said stationary track, as said seat link moves from upright chair position to inclined chair position, and to move said body rearwardly relatively to said stationary track as said seat link moves back from inclined position to upright position, said means for mounting said chair body on said stationary track comprising a horizontal movable track fixed to said body, a wheel rotatably mounted on the stationary track and having rolling contact with an undersurface of said movable track, and a wheel rotatably mounted on said movable track and having rolling contact with a top surface of said stationary track and being located above the first mentioned wheel, said linkage comprising a link pivoted to said stationary track, a bellcrank pivoted to said body and also pivoted to the link which is pivoted to the stationary track, said linkage mechanism comprising a member pivoted to said seat link, and a link pivoted to said bellcrank and also pivoted to the link which is pivoted to said seat link.

14. The combination of claim 13, said link pivoted to said body having a portion disposed in a vertical plane, when said seat link is in the upright position of the chair.

15. A chair comprising a chair body, a horizontal stationary track adapted to be supported on a floor, means for mounting said chair body on said stationary track for horizontal longitudinal sliding movement of said body relative to said stationary track, a seat link, linkage mechanism connecting said seat link with said body to permit movement of the seat link from upright chair position to inclined position and back from inclined position to upright position, and linkage connecting said stationary track with said linkage mechanism, to cause said body to move longitudinally forwardly relative to said stationary track while being slidably supported on said stationary track, as said seat link moves from upright chair position to inclined chair position, and to move said body rearwardly relatively to said stationary track as said seat link moves back from inclined position to upright position, a legrest, means to connect said linkage mechanism to said legrest to project said legrest upon moving said seat link from upright position to inclined position, said means to connect said linkage mechanism to said legrest comprising a link pivoted to said seat link, a link pivoted to said stationary track, a bellcrank pivoted to said body and to said link which is pivoted to said stationary track, and a link pivotally connected to said bellcrank and to the link which is pivoted to the seat link.

16. The combination of claim 15, said means for mounting said chair body on said stationary track comprising a horizontal movable track fixed to said body, a wheel rotatably mounted on the stationary track and having rolling contact with an undersurface of said movable track, and a wheel rotatably mounted on said movable track and being located above the first mentioned wheel and having rolling contact with a top surface of said stationary track.

17. The combination of claim 16, said wheel which is rotatably mounted on said movable track being located near the rear end of said movable track, said wheel which is movably mounted on said stationary track being located near the front end of said stationary track.

18. The combination of claim 17, said stationary track comprising a flange projecting up between the wheel on the movable track and a portion of the movable track on which the wheel on the movable track is mounted, the movable track having a downwardly extending flange extending between the wheel on the stationary track and a portion of the stationary track on which the wheel on the stationary track is mounted.

19. The combination of claim 18, and bumper buttons on said tracks to limit sidewise movement of said tracks toward each other.

20. The combination of claim 19, and means on said tracks to restrict vertical relative movement between said tracks.

* * * * *

UNITED STATES PATENT AND TRADEMARK OFFICE

CERTIFICATE OF CORRECTION

PATENT NO. : 4,077,663

DATED : March 7, 1978

INVENTOR(S) : Izchak Cycowicz et al.

It is certified that error appears in the above-identified patent and that said Letters Patent are hereby corrected as shown below:

On the front page of the above-identified patent:

Please cancel "16 Drawing Figures" and substitute --5 Drawing Figures--.

Signed and Sealed this

*Nineteenth* Day of *September 1978*

[SEAL]

*Attest:*

RUTH C. MASON
*Attesting Officer*

DONALD W. BANNER
*Commissioner of Patents and Trademarks*